United States Patent [19]

Shields

[11] 4,364,585

[45] * Dec. 21, 1982

[54] SKI POLE

[76] Inventor: Michael P. Shields, 5977 Reseda Blvd., Tarzana, Calif. 91356

[ * ] Notice: The portion of the term of this patent subsequent to Jan. 27, 1998, has been disclaimed.

[21] Appl. No.: 19,738

[22] Filed: Mar. 12, 1979

Related U.S. Application Data

[63] Continuation-in-part of Ser. No. 886,931, Mar. 15, 1978, Pat. No. 4,247,132, which is a continuation-in-part of Ser. No. 783,170, Mar. 31, 1977, Pat. No. 4,175,683.

[51] Int. Cl.[3] ..... A63C 11/22

[52] U.S. Cl. ..... 280/814; 280/820; 280/822; 294/147

[58] Field of Search ..... 224/45 S, 50, 49, 45 R, 224/55, 58, 917; 280/11.37 K, 11.37 A, 11.37 H, 11.37 B, 11.37 Z, 11.37 E, 814, 820, 824, 821, 819, 822, 816; 211/60 SK; 294/147, 153, 154

[56] References Cited

U.S. PATENT DOCUMENTS

| | | | |
|---|---|---|---|
| 1,961,099 | 5/1934 | Dickson | 280/821 |
| 2,533,733 | 12/1950 | Jensen | 280/823 X |
| 3,113,786 | 12/1963 | Phillipson | 280/11.37 B |
| 3,378,272 | 4/1968 | Lewis | 280/821 X |
| 3,433,495 | 3/1969 | Christensen | 280/821 |
| 3,737,956 | 6/1973 | Gragert | 280/11.37 A |
| 4,010,961 | 3/1977 | Goode | 280/11.37 A |

FOREIGN PATENT DOCUMENTS

| | | | |
|---|---|---|---|
| 261459 | 4/1968 | Austria | 280/11.37 A |
| 842085 | 5/1970 | Canada | 280/11.37 B |
| 2611072 | 7/1977 | Fed. Rep. of Germany | 280/11.37 B |
| 630919 | 12/1961 | Italy | 280/819 |
| 144145 | 2/1954 | Sweden | 280/821 |
| 502829 | 3/1971 | Switzerland | 280/11.37 A |

*Primary Examiner*—Robert B. Reeves
*Assistant Examiner*—Edward M. Wacyra
*Attorney, Agent, or Firm*—Lyon & Lyon

[57] ABSTRACT

A ski pole having a basket and grip configuration for use in carrying a pair of skis. The basket defines a first gripping surface for securing the basket to a pair of skis and a second gripping surface for securing the basket to the grip end of a second pole. The grip of each pole is provided with an adjustable rotatably mounted strap for use in holding the basket in gripping contact with the skis. So secured, the skis and two poles are held together to facilitate carrying.

15 Claims, 8 Drawing Figures

10
12
14
16
18
20
22
24
26
28
30
32
34
36
38
40
42
44
46
48
50

SKI POLE

This application is a continuation-in-part of Ser. No. 886,931, now U.S. Pat. No. 4,247,132, filed on Mar. 15, 1978 entitled "Ski Pole", which in turn is a continuation-in-part of Ser. No. 783,170, now U.S. Pat. No. 4,175,683, filed on Mar. 31, 1977 and entitled "Ski Pole Basket Carrying Assembly".

BACKGROUND OF THE INVENTION

The present invention relates to a ski pole, the basket and grip of which when used in combination with a second such pole define a carrying assembly for the snow skier's poles and skis. Snow skis and poles are inherently bulky and unwieldy and accordingly have presented a handling problem when they must be manually carried over any distance. While a few devices have been heretofore developed in an attempt to assist the skier in handling his equipment, such as those described in U.S. Pat. Nos. 3,877,623 and 3,774,826, these devices have met with little acceptance as they have merely substituted one problem for another. The benefit obtained from such devices in facilitating the carrying of one's equipment is offset by the added problem of storing such a device while skiing. As convenient storage facilities are not always readily available and many skiers wish to spend every available minute on the slopes as opposed to searching out such facilities, additional carrying equipment has proved to be quite unpopular. Accordingly, skiers have continued to either secure their skies together with the conventional rubber straps or the like, or to place the safety straps of the ski poles about the skis in any number of ways in an attempt to reduce the unwieldiness of the equipment. The inevitable result of many such attempts is a comical spectacle involving the knocking and scraping together of the skis causing damage and dulling to the edges of the skis and often injury to passersby.

SUMMARY OF THE INVENTION

Briefly, the present invention relates to a ski pole having basket and grip portions useful in securing said pole to a second pole of similar construction and to a pair of skis to facilitate carrying of said skis and poles. The basket of the ski pole is adapted to be readily secured both to the other pole adjacent the grip thereof and to transverse portions of the skis. The handle strap of the grip is readily extended about the skis to maintain the skis and poles together for carrying. In one embodiment of the handle strap, more convenient access for a skier's gloved hand is provided.

It is therefore the principal object of the present invention to provide an improved assembly for facilitating the carrying of snow skis and ski poles.

It is another object of the present invention to provide an assembly for carrying snow skis and ski poles which eliminates the need for an additional carrying device.

It is a further object of the present invention to provide a ski pole, the basket and grip portions of which are useful for securing the ski pole both to a second pole and to a pair of skis to facilitate carrying of said poles and skis.

It is a still further object of the present invention to provide a ski pole whose handle strap provides convenient access to a skier wearing ski gloves.

These and other objects and advantages of the present invention will become apparent from the following detailed description taken in conjunction with the accompanying drawings.

DESCRIPTION OF THE PREFERRED EMBODIMENT

In the drawings, FIG. 1 is a perspective view of a pair of skis and ski poles held together by the ski pole assembly of the present invention.

Figures 1, 2, 3:
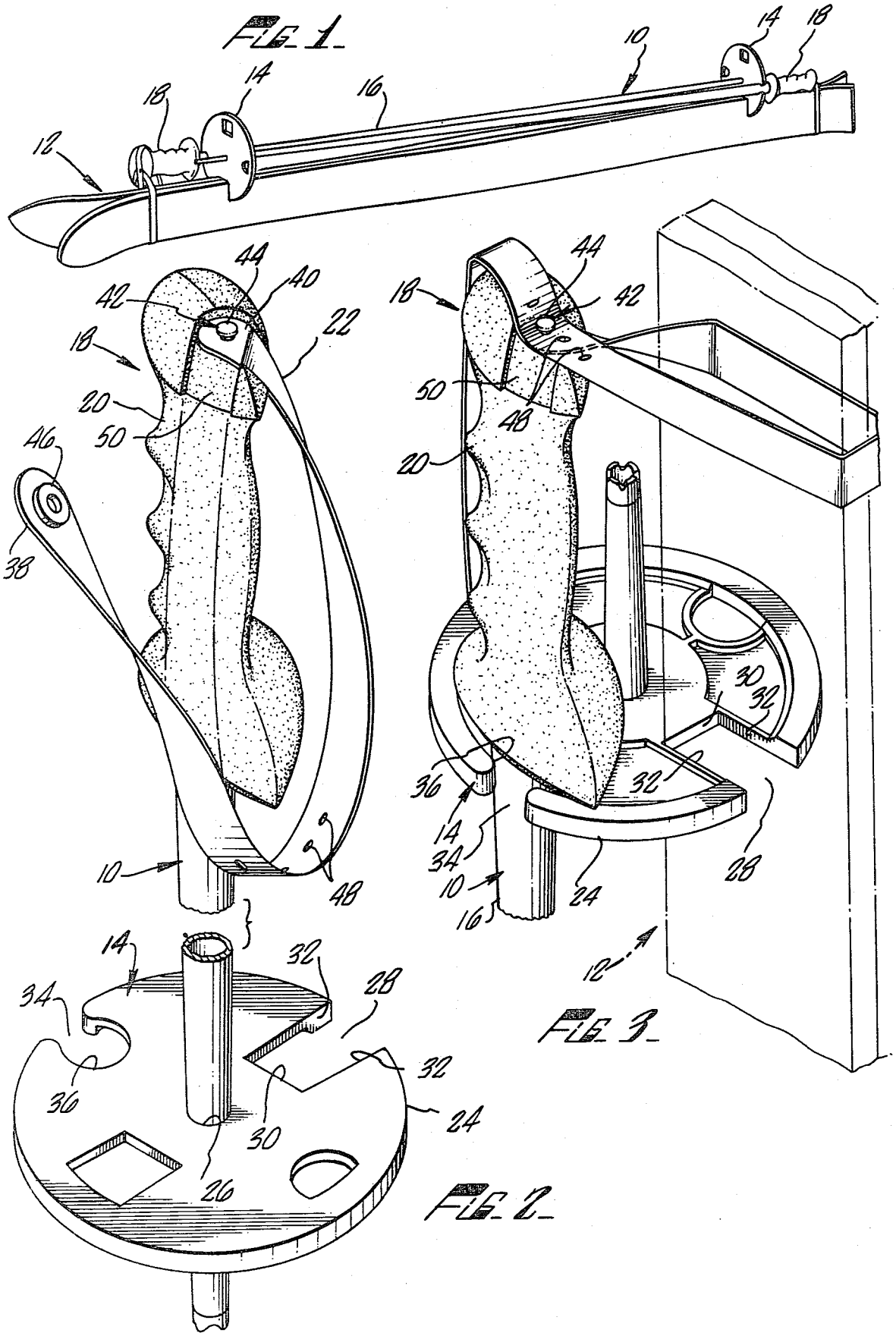
FIG. 2 is a perspective view of the ski pole of the present invention.
FIG. 3 is an enlarged partial perspective view of the ski pole and basket to bring together a pair of snow skis.

Referring now in detail to the drawings, the ski pole 10 of the present invention is illustrated in FIG. 1 secured to a second pole of the same construction and to a pair of skis 12 to define a compact horizontal carrying assembly wherein the poles act as a handle. The ski pole 10 of the present invention is comprised of a basket 14, shaft 16 and a grip 18.

The ski pole basket 14 is shown most clearly in FIG. 2 and is comprised of a body portion 24 preferably constructed of a resilient plastic material and having a central aperture 26 extending therethrough for receiving the ski pole shaft 16. A first substantially rectangularly shaped recessed area 28 is formed in the body portion 24. This recessed area 28 is defined by a back wall 30 and side walls 32 which are slightly tapered toward each other so that the outer portion of the recessed area 28 is narrower than near the back wall 30. This tapering insures a better grip on the skis. A second recessed area 34 is defined by a curvilinear wall 36. The second recessed area 34 is disposed 90° about the body portion of the basket from the first recessed area 28 and the curvilinear wall 36 defining area 34 extends over center to reduce the transversed dimension of the outer opened end thereof and thereby define a gripping surface for securing the basket 14 to the shaft of a second ski pole as illustrated in FIGS. 1 and 3. The rectangular recessed area 28 is adapted to receive a transversed portion of a pair of skis 12 as is also illustrated in FIGS. 1 and 3. Upon placing the skis within area 28, the resilient nature of the material from which the basket is constructed and the natural camber in the skis causes the side walls 32 to press tightly against the skis thereby securing the basket 14 to the skis 12.

The ski pole grip 18 is best seen in FIG. 3 and includes a handle portion 20 which is affixed to the upper end of the ski pole shaft 16 and a safety strap 22, at least one end 38 of which is detachable from the handle portion of the grip. In the preferred embodiment of the invention illustrated in the drawings, the other end 40 of the strap is secured to the handle such that it is free to swivel about the handle. This mounting can be achieved by a pin 42 having an enlarged head 44 which is carried by the handle and to which end 40 is secured. The detachable end 38 of the strap 22 is provided with a first locking means (aperture) 46 by which that end is secured to the handle for skiing and a plurality of secondary adjustable locking means (spaced apertures) 48 by which the strap can be secured to the handle when disposed about a pair of skis for carrying, as shown in FIGS. 1 and 3. In addition, the grip is provided with inverted "V" shaped recessed upper areas 50 which are adapted to receive the strap adjacent to the ends 38 and 40 thereof so that when skiing, the strap and the pin 42 do not extend above the body of the handle.

To secure the ski poles 10 to the skis 12 for carrying as illustrated in FIG. 1, the shafts 16 of the ski poles are inserted into the curvilinear recessed areas 34 in the body portion of the ski pole baskets 14 adjacent the grips 18 thereof thereby locking the ski poles together. In lieu of securing the baskets 14 to the ski pole shaft as described, the baskets could also be secured directly to the handle of the other pole. In such a case, the configuration of the recessed areas might vary according to the ski pole handle configuration in view of the new right and left handed ski poles.

With the ski poles so secured, the skis 12 are inserted into the rectangularly shaped recessed areas 28 in the body portions of the baskets thereby securing the poles to the skis. In view of the weight of the skis, to prevent the skis from falling from the recessed areas 28 while being carried, the detachable end 38 of the safety strap is disengaged from pin 42, the strap is extended about the skis and secured back onto the pin by means of one of the spaced apertures 48 located about midway along the strap. The straps 22 which are preferably constructed of an elastic material thus secure and maintain the skis within the recessed areas of the ski pole baskets to provide a secure and compact assembly for carrying.

In addition to providing an improved assembly for carrying one's skis, the ski pole 10 also has the added safety feature of a releasable safety strap which will disengage from the ski pole handle should the ski pole become entangled with an immovable object such as a tree or the like when skiing thereby precluding any injury which otherwise might occur to the skier's wrist or arm. While in the drawings only one means is illustrated for securing the strap 22 to the ski pole handle 20 such that one end of the strap is detachable and the other is preferably free to swivel about the handle, it is to be understood that different means could be employed for accomplishing such attachment. For example, if the basket were secured to the ski pole shaft by a friction ring or the like such that it was prevented from undergoing any rotational movement with respect to the shaft, it would not be necessary to swivelly mount the end 40 of the safety strap onto the ski pole handle. During construction of the ski pole, the handle could be mounted on the shaft such that the strap would always be properly aligned with respect to the skis when securing the skis to the ski pole basket.

Figure 4:
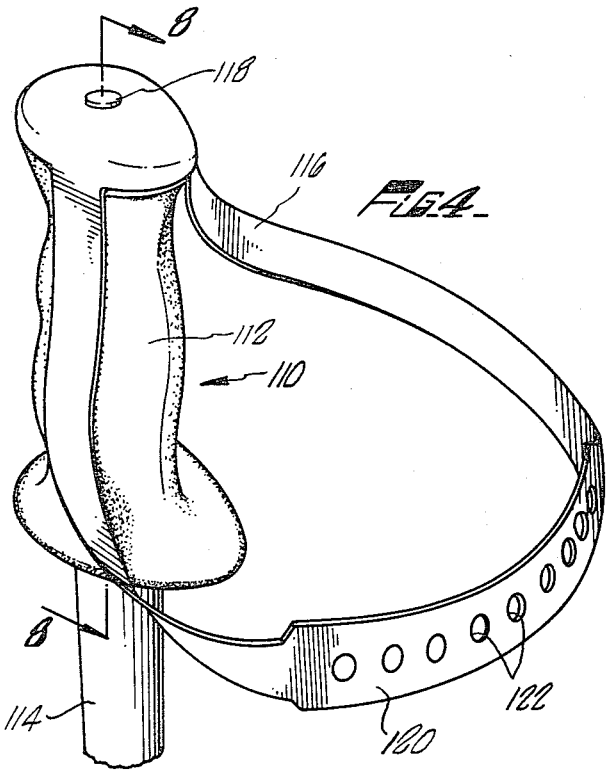
FIG. 4 is a perspective view of an alternative embodiment of the grip and associated handle strap of the ski pole of the present invention.

FIGS. 4–8 illustrate an alternative embodiment of the ski pole grip. Referring first to FIG. 4, the grip 110 includes a handle portion 112 affixed to the upper end of the ski pole shaft 114, and a safety strap 116 secured to the top of the handle 112 by a pin 118. In the main body portion 120 of the strap 116 there are formed a plurality of spaced apertures 122 for securing the strap 116 to the handle 112 when the strap 116 is disposed about a pair of skis for carrying, substantially as previously described. In the embodiment illustrated in FIGS. 4–8, the main body portion 120 of the strap has an enlarged transversse dimension to better accommodate the apertures 122.

Figure 5:
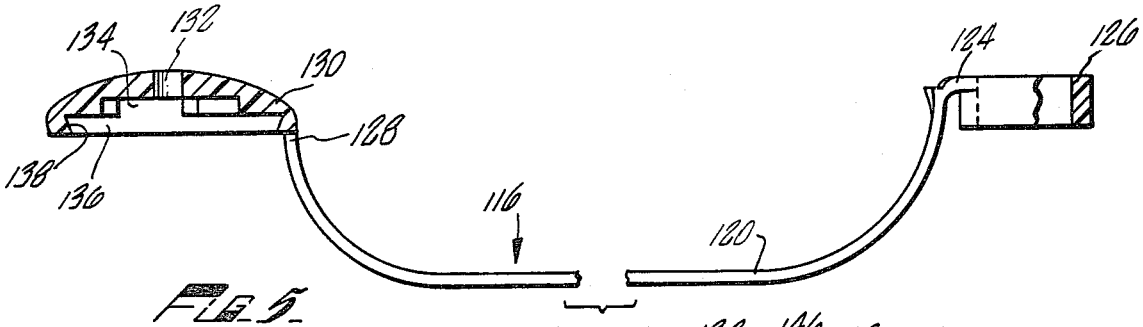
FIG. 5 is a side view, in partial cross-section, of the handle strap shown in FIG. 4.

The construction of the strap 116 is better illustrated in FIG. 5. At one end 124 of the strap 116 there is an annular body 126, and at the other end 128 there is a somewhat dome-shaped body or cap 130 having formed therein a central aperture 132, an intermediate cavity 134, and a lower cavity 136 having tapered sides 138. The strap 116 is molded of a relatively rigid but flexible material, preferably an elastomer having good cold weather characteristics, to retain the shape shown in FIG. 5, that is, the main body 120 of the strap 116 being curved upward near the ends 124 and 128. When both ends 124 and 128 of the strap 116 are affixed to the top of the handle portion 112, therefore, the natural rigidity of the strap 116 and its molded configuration defining the curves formed in the main body 120 thereof causes the main body 120 to be supported in an open and substantially horizontal disposition away from the handle 112 of the grip 110 to facilitate reception of the user's hand and wrist therethrough.

As seen in FIG. 4, the strap 116 is twisted 180 degrees outwardly from the ski pole 114 such that the inner edges 117 of the strap 116 adjacent the ends thereof become the lower edge 119 of the main body portion 120 of the strap. This twist in the strap positions and maintains the open loop in a horizontal disposition and is most clearly seen in the perspective shown in FIG. 4 at 116'. If the strap did not have the twist shown in FIG. 4, the strap, while remaining open, would be vertically disposed against the ski pole shaft 114. This construction allows a skier to easily insert his hand through the strap 116, even when wearing a bulky skiing glove, and to grasp in his hand the handle 112 and the portions of the strap 116 nearest the ends 124 and 128 thereof, while retaining the main body 120 of the strap 116 around the skier's wrist for safety. Additionally, the cap 130 is molded to blend with the natural contour of the handle 112, and the edges of the strap 116 which are in the skier's grasp may be chamfered to blend with the handle contour for greater comfort while skiing.

Figure 6:
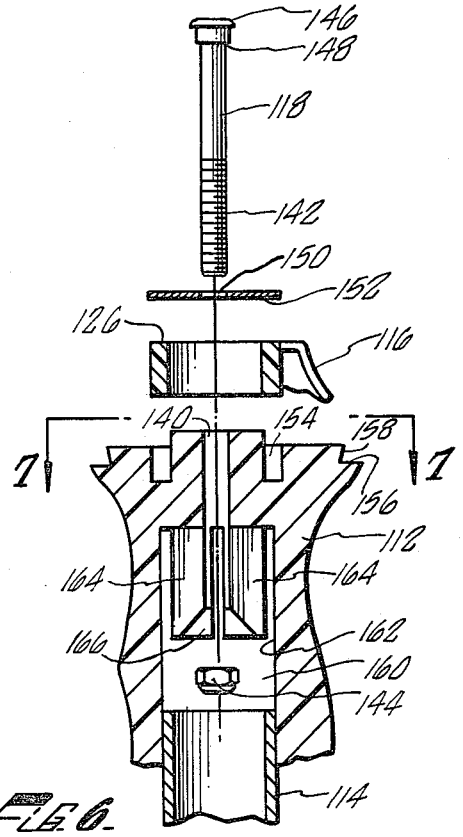
FIG. 6 is an exploded partial side view, in cross-section, of the grip shown in FIG. 4.

FIG. 6 illustrates detail of the grip and ski pole assembly. The handle 112 has a central bore 140 drilled therethrough for receiving the pin 118, which contains threads 142 for coupling with a nut 144. The pin 118 also has an enlarged head 146 and a flange 148 slightly therebelow. The flange 148 is of slightly greater diameter than an aperture 150 of a washer 152, so that when the grip 110 is assembled and the pin 118 inserted through the washer 152, the head 146 of the pin 118 is supported above the surface of the washer 152. The diameter of the washer 152 should be substantially equivalent to the outer diameter of the annular body 126.

An annular recess 154 is formed in the upper end of the handle 112 for receiving the annular body 126 of the strap 116. A top notch 156 is cut into the circumference of the upper end of the handle 112, with a tapered edge 158 for mating with the tapered sides 138 of the cap 130 to achieve a positive "snap-on" fit therebetween.

The ski pole shaft 114 is received within a cavity 160 formed in the lower end of the handle 112. More particularly, the ski pole shaft 114 fits between the wall 162 of the cavity 160 and a plurality of downwardly extending lugs 164 in the cavity 160, the bore 140 extending through the lugs 164. Each of the lugs 164 contains a notch 166 at its lower end, forming an area shaped like a cone into which the nut 144 fits. The grip and ski pole are assembled by inserting the ski pole shaft 114 fully into the cavity 160, placing the annular body 126 into the annular recess 154, placing the washer 152 above the annular body 126, inserting the pin 118 through the washer 152, the annular body 126, and the bore 140, and tightening the nut 144 onto the pin 118. This causes the nut 144 to press against the notched underside of the lugs 164 and thus spreads the lugs 164 outwardly to grip the ski pole shaft 114 securely between the lugs 164 and the wall 162 of the cavity 160.

Figure 7:
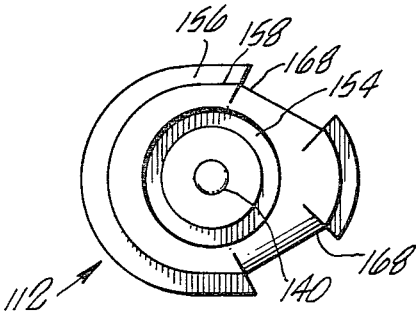
FIG. 7 is a top view of the grip shown in FIG. 4.

FIG. 7 is a top view of the handle 112 taken along the line 7—7 of FIG. 6. The same features described in connection with FIG. 6 are visible in the view of FIG. 7, and additionally, FIG. 7 illustrates that there are formed in the handle 112 inverted "V" shaped recessed upper areas 168. In substantially the same manner as previously described in connection with FIGS. 1–3, the areas 168 are adapted to receive the portions of the strap 116 adjacent the ends 124 and 128 thereof, so that when the strap 116 and the handle portion 112 are grasped by a skier, the strap 116 does not extend above the body of the handle 112.

Figure 8:
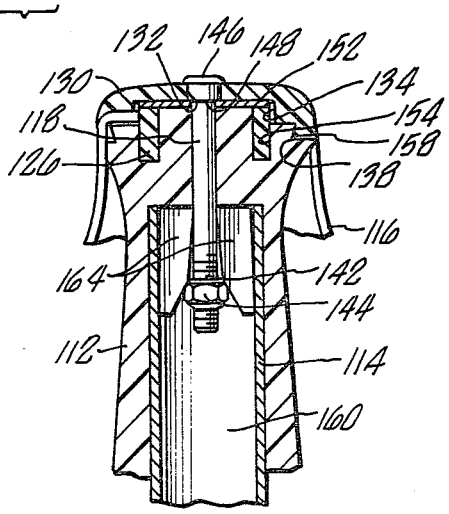
FIG. 8 is a partial side view, in cross-section, of the assembled grip shown in FIG. 4.

FIG. 8, which is a sectional view taken along the line 8—8 of FIG. 4, shows the fully assembled grip and ski pole shaft. The ski pole shaft 114 has been inserted into the cavity 160, and is held securely therein by the pressure of the lugs 164 resulting from tightening the nut 144 onto the threads 142 of the pin 118. The annular body 126 is received within the annular recess 154, the washer 152 is placed over the annular body 126, and the head 146 of the pin 118 is supported above the washer 152 by the flange 148, permitting the cap 130 to be snapped onto the head 146 of the pin 118 through the aperture 132, at the same time snapping onto the handle 112 through engagement of the tapered edge 158 with the tapered sides 138. The cap 130 easily releases from the pin 118 when desired, such as in an emergency situation, simply by exerting an upward force thereon with the skier's wrist. When it is desired to assemble the ski poles and skis for carrying, the cap 130 is unsnapped from the pin 118 and the handle 112 and the strap 116 is extended about the skis and secured back onto the pin 118 by means of one of the spaced apertures 122. The relative longitudinal rigidity of the strap 116 may not permit the strap 116 to stretch as much as the elastic strap 22 described in connection with FIGS. 1–3, but adequate adjusttment for any size skis may be effected by providing an adequate number of the apertures 122 in the strap 116. The annular body 126 of the strap 116 swivels in the annular recess 154 to allow the strap 116 easily to be extended around a pair of skis, and to prevent undue wear on the strap 116 when it is used to carry a pair of skis. Also, the annular construction of the body 126 substantially reduces the strain thereon which would result if the strap 116 were directly affixed to the pin 118.

Various other changes and modifications may be made in carrying out the present invention without departing from the spirit and scope thereof. Insofar as these changes and modifications are within the purview of the appended claims, they are to be considered as part of the present invention.

I claim:

1. A ski pole for use in securing together a pair of skis to facilitate carrying thereof, said ski pole comprising a basket, a ski pole shaft and a grip, said basket being carried by said shaft and having a first recessed area therein, said area defining a curvilinear gripping surface and having an outer opening of reduced transverse dimension for receiving and retaining a second ski pole therein and a second recessed area readily positioned within said basket and disposed approximately 90° about said basket with respect to said first recessed area for receiving a transverse portion of a pair of adjacently disposed skis, said grip being secured to the upper end of said shaft and including a handle and an expansible safety strap, one end of said strap being swivelly mounted on said handle, the other end of said strap being detachably mounted to said handle and said strap including means intermediary to the ends thereof for adjustably securing said strap to said handle upon said strap being extended about said pair of adjacently disposed skis such that upon disposing each of said poles in the region adjacent the grips thereon within said first recessed area in the basket of the other pole, said poles are secured together and upon disposing said transverse portions of said skis within said second recessed areas of said baskets and securing said straps intermediary of the ends thereof about said skis to said handles, said skis are tightly seured to said poles for the carrying of said poles and skis.

2. The combination of claim 1 including a pin member having an enlarged head portion carried by said handle in the upper end thereof, said strap having apertures adjacent each end thereof and at least one intermediary aperture disposed therebetween such that upon inserting said pin member through the apertures disposed adjacent the ends of said strap, said strap is detachably mounted on said pole in a skiing mode and upon detaching one end of said strap from said pin member, extending said strap about said pair of adjacently disposed skis and inserting said pin member through said at least one intermediary aperture, said skis are secured to said basket and ski pole.

3. The combination of claim 2 including an inverted "V"-shaped channel disposed in the upper end of said handles adapted to receive portions of said strap adjacent the ends thereof such that in a skiing mode said portions of said strap lie substantially flush with said handles.

4. The combination of claim 1 including a first plug secured to said one end of said strap, said plug having a recess in the upper end thereof and being rotatably mounted in the upper end of said handle, and a second plug secured to said other end of said strap and being adapted to be disposed in said recess in said first plug for securing said ends of said strap to said handle.

5. The combination of claim 1 including an annular body secured to said one end of said strap and being rotatably mounted in the upper end of said handle by being at least partially received in an annular recess thereof, and a cap secured to said other end of said strap and having an intermediate recess and a lower recess therein, said intermediate recess being adapted to receive a portion of said annular body and said lower recess being adapted to engage a circumferential notch in said upper end of said handle for securing said other end of said strap to said handle.

6. The combination of claim 1 including a pin member having an enlarged head portion carried by said handle in the upper end thereof, an annular body secured to said one end of said strap and being rotatably mounted in the upper end of said handle by being at least partially received in an annular recess thereof, and a cap secured to said other end of said strap and having a central aperture and a recess therein, said recess being adapted to receive said annular body and said central aperture being adapted to snap onto said head portion of said pin member, said means for adjustably securing said strap including at least one intermediary aperture in said strap between said ends, such that upon inserting said pin member through said central aperture and inserting said annular body into said recess, said strap is detachably mounted on said pole in a skiing mode and upon detaching said other end of said strap from said pin member, extending said strap about said pair of adjacently disposed skis and inserting said pin member through said at least one intermediate aperture, said skis are secured to said basket and ski pole.

7. The combination of claim 1 wherein said strap is molded of a shape-retaining material such that when said strap is mounted on said handle, said strap is supported between the ends thereof away from said handle.

8. The combination of claim 1 including a first member secured to one end of said strap, said member being swivelly mounted in the upper end of said handle, and a second member secured to said other end of said strap and being adapted to engage said upper end of said handle for securing said other end of said strap to said handle.

9. A grip for a ski pole comprising a handle portion and a safety strap, said handle portion having an annular recess in the upper end thereof, one end of said safety strap defining an annular body member at least partially disposed within said recess such that said one end is swivelly mounted on said handle portion, the other end of said strap being releasably mounted upon the upper end of said handle, said strap being molded of a shape-retaining material such thart when both ends of said strap are secured to the upper end of said handle for skiing, said strap is self-supported between the ends thereof so as to define an open loop extending outwardly and away from said handle portion.

10. The grip of claim 9 further including a cavity in the lower end of said handle for receiving a ski pole shaft and means for securing said ski pole shaft within said cavity, said means comprising a plurality of lugs affixed to the upper surface of said cavity and means for spreading the lower ends of said lugs to engage said ski pole shaft between said lugs and the walls of said cavity.

11. A ski pole grip for use in securing together a pair of skis to facilitate carrying, said grip comprising a handle portion and an expansible safety strap, said handle portion having a recess in the upper end thereof, one end of said strap defining a body member at least partially disposed within said recess such that said one end is swivelly mounted on said handle portion, the other end of said strap including means integral therewith adapted to engage the upper portion of said handle portion for releasably mounting said other end on said handle portion, and means intermediary of the ends thereof for adjustably securing said strap intermediary of the ends thereof to said handle portion upon said strap being extended about said pair of adjacently disposed skis thereby securing said ski pole grip to said skis.

12. The combination of claim 11 including a pin member having an enlarged head portion carried by said handle in the upper end thereof, said strap having apertures adjacent each end thereof and at least one intermediary aperture disposed therebetween such that upon inserting said pin member through the apertures disposed adjacent the ends of said strap, said strap is detachably mounted on said handle portion in a skiing mode and upon detaching one end of said strap from said pin member, extending said strap about said pair of adjacently disposed skis and inserting said pin member through said at least one intermediary aperture, said skis are secured to said ski pole grip.

13. A grip for a ski pole comprising a handle portion and an integrally molded safety strap, said handle portion having an annular recess disposed in the upper end thereof, one end of said strap defining an annular body member disposed within said recess thereby providing a swivel mounting for said end of said strap on said handle portion, the other end of said strap defining a cap member adapted to fit over a portion of the upper end of said handle portion, said strap being molded of a shape-retaining material such that when both ends of said strap are secured to the upper end of said handle for skiing, said strap is supported between the ends thereof so as to define an open loop extending outwardly and away from said handle portion, and means for releasably securing said cap member to the upper end of said handle portion.

14. The combination of claim 13 wherein said releasable securing means comprises a pin mounted within said handle portion interiorly of said recessed area, an aperture disposed within said cap member for receiving said pin, a first annular contact surface defined by the perimeter portion of the upper end of said handle portion, and a second annular contact surface defined by the underside of said cap member adapted for mating engagement with said first surface.

15. A ski pole grip for use in securing together a pair of skis to facilitate carrying, said grip comrising a handle portion and an expansible safety strap, one end of said strap having a plug secured thereto, said plug having a recess in the upper end thereof and being rotatably mounted in the upper end of said handle, a second plug secured to the other end of said strap and being adapted to be disposed in said recess in said first plug for securing said ends of said strap to said handle, a pin member having an enlarged head portion carried by said handle portion in the upper end thereof, said strap having apertures adjacent each end thereof and at least one intermediary aperture disposed therebetween such that upon inserting said pin member through the apertures disposed adjacent the ends of said strap, said strap is detachably mounted on said handle portion in a skiing mode and upon detaching one end of said strap from said pin member, extending said strap about said pair of adjacently disposed skis and inserting said pin member through said at least one intermediary aperture, said skis are secured to said ski pole grip.

* * * * *